US005570526A

United States Patent [19]

Wallon

[11] Patent Number: 5,570,526

[45] Date of Patent: Nov. 5, 1996

[54] PICTURE FRAME STAND CLIP

[76] Inventor: Edward J. Wallon, 1836 Vanhill, Rochester Hills, Mich. 48309

[21] Appl. No.: 505,878

[22] Filed: Jul. 24, 1995

[51] Int. Cl.[6] ..... G09F 1/12

[52] U.S. Cl. ..... 40/748; 40/755; 248/455

[58] Field of Search ..... 40/748, 749, 754, 40/755, 756; 248/455

[56] References Cited

U.S. PATENT DOCUMENTS

| | | | |
|---|---|---|---|
| 2,007,534 | 7/1935 | Kapnek | 248/455 |
| 2,007,535 | 7/1935 | Kapnek | 248/455 |
| 2,115,448 | 4/1938 | Pradt | 40/755 X |
| 3,360,227 | 12/1967 | Overton et al. . | |
| 3,616,558 | 11/1971 | Jahn . | |
| 3,938,772 | 2/1976 | Andrusiak | 40/748 X |
| 4,805,325 | 2/1989 | Cassard . | |
| 4,878,266 | 11/1989 | Cubides . | |
| 5,253,440 | 10/1993 | Chang . | |
| 5,291,635 | 3/1994 | Schmale . | |
| 5,335,434 | 8/1994 | Shultz et al. . | |
| 5,371,924 | 12/1994 | Schmale . | |

FOREIGN PATENT DOCUMENTS

| | | | |
|---|---|---|---|
| 10060 | 8/1895 | United Kingdom | 40/152.1 |

*Primary Examiner*—Brian K. Green

*Attorney, Agent, or Firm*—Reising, Ethington, Barnard & Perry

[57] ABSTRACT

A clip (12) for a picture frame assembly (10) includes a first and second leg (20,22) made from a spring steel. One leg has a Velcro fastener (26,30) for connection with a rear of the frame section and the other leg (22) has a catch (35) that laterally engages an edge (36) of a supportive tongue (18) to secure the tongue (18) at a desired angle with respect to the frame section (16) of the picture frame assembly.

10 Claims, 1 Drawing Sheet

PICTURE FRAME STAND CLIP

TECHNICAL FIELD

The field of this invention relates to stand-up picture frames and more particularly to a support clip for use to brace a picture frame support tongue.

BACKGROUND OF THE DISCLOSURE

Picture frames are either hung on a wall or have a rear support tongue that allows the picture frame to rest on a horizontal table surface. The tongue is often attached to a back panel of the picture frame via a hinge such that the tongue can lay flat against the panel during shipping or during placement of the frame on a wall.

While the hinge may provide ease in packaging, shipping and storing of the frame, it often introduces other problems of durability and adjustment. The hinge has a stop such that it allows the tongue to open a certain distance. The picture frame rests at an angle on a table surface set by the hinge and tongue. While the tongue is initially designed to stop at a certain angle, the hinge often deteriorates and the tongue often does not stay at the designed angle but often is positioned at a further splayed angle to provide a more oblique cant of the picture frame. The tongue also is often made from cardboard and if bent, loses its supportive capabilities. The picture frame then falls over and is incapable of being stood upright on a table surface.

Furthermore, if the tongue is set at a steep angle in order to provide for a near vertical presentation of the picture, the picture is sensitive to disturbances. A slight disturbance of the tongue allows the tongue to pivot closer and lose its supportive capability. The picture then falls over either forwardly or rearwardly.

When several picture frames are used for a collection of pictures, it is desirable to have all the picture frames set at the same angle to provide a consistency of the presentation of the various pictures and photographs. Furthermore, if a collection of many frames are presented in a relatively small area, a relatively upright position of the picture frames is needed. However, different brands and types of frames have varying set angles for the tongue. Some of these angles are significantly more oblique than others. It is difficult for the tongue to be balanced at a narrower angle such that all the picture frames are set at the same upright cant.

What is needed is a device that provides support for a stand-up picture frame on a table surface when the picture frame has a broken hinge or bent support tongue. What is also needed is a support to allow adjustment of the tongue for setting the picture frame on a table surface at a desired angle.

SUMMARY OF THE DISCLOSURE

In accordance with one aspect of the invention, a picture frame includes a front frame section constructed for mounting a picture and a rear support tongue having a top end hingedly connected to the rear surface of the front frame section. A hinge mechanism connects the support tongue to the front frame section. A support clip is interposed under the hinge between the tongue and front picture. The clip has two leg sections and a bendable central bight section. The first leg section is parallel and adjacent to the front frame section. The second leg section is parallel and adjacent to the support tongue. The first and second legs are integrally formed together and are adjustably set at a selected angle by bending the upper bight section.

The first and second components of a detachable fastening mechanism are secured onto the respective first leg and a rear surface of the frame section for removably attaching the first leg to the rear surface of said frame section. Preferably, the detachable fastening mechanism is a hook and loop fastening device such as the well known Velcro brand with one of a hook connector and loop connector being secured on the picture frame and the other of the hook connector and loop connector being secured on an opposing surface of the first leg.

The second leg has a securement device for removably being secured to the tongue such that the tongue is secured with respect to the frame section at the selected angle. Preferably, the securement device on said second leg is a catch on the leg that is bent to form a groove to laterally receive the tongue.

Alternately, the securement device includes a u-shaped catch pivotably connected onto the second leg. The catch forms the groove and is pivotable to allow the groove to receive a selected left or right edge of the tongue depending on the pivoted position of the u-shaped catch.

In another embodiment, the second leg has a slot that runs laterally therethrough. A separate u-shaped catch has a leg that extends through the slot. The groove formed in the u-shaped catch receives a selected left or right edge of the tongue depending on the position of the u-shaped catch through the slot.

In accordance with another aspect of the invention, the invention is directed to the described support clip for the picture frame for attachment to a tongue of a picture frame and a back panel of the picture frame.

BRIEF DESCRIPTION OF THE DRAWINGS

Reference now is made to the accompanying drawings in which.

DETAILED DESCRIPTION OF THE PREFERRED EMBODIMENT

Figure 1:
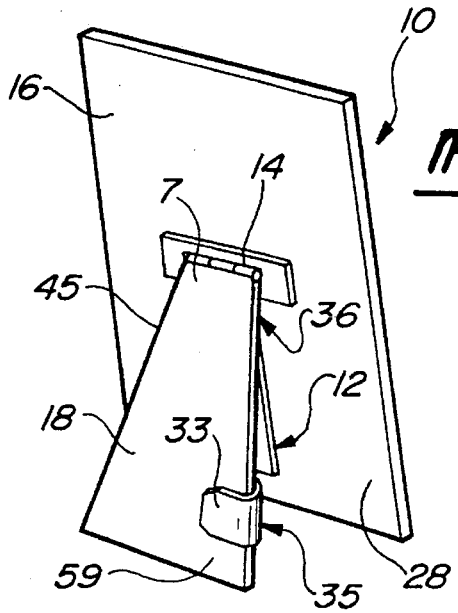
FIG. 1 is a rear perspective drawing of a picture frame assembly in accordance with one embodiment of the invention.
Figure 2:
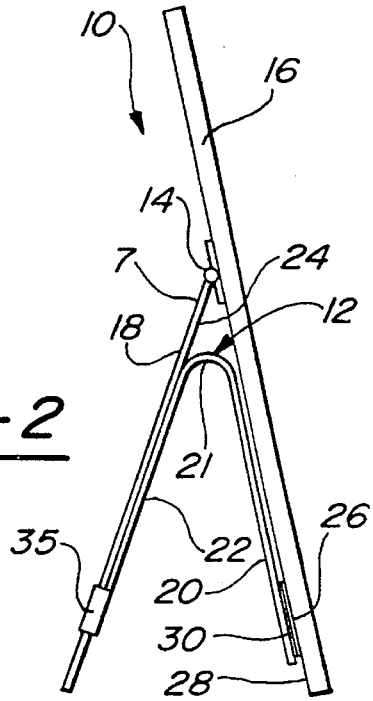
FIG. 2 is side elevational view of the picture frame assembly shown in FIG. 1.
Figure 3:
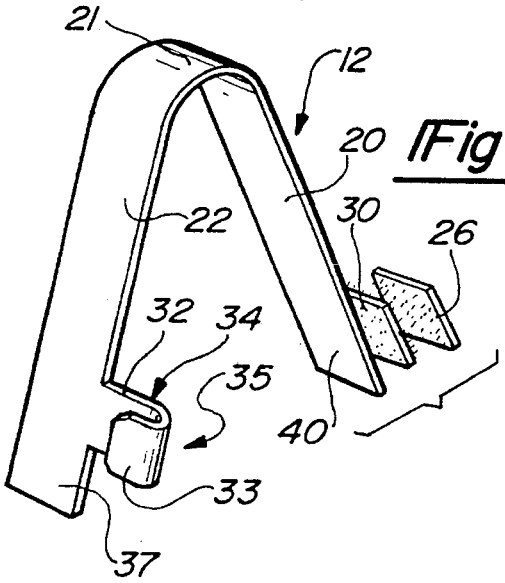
FIG. 3 is an exploded rear perspective view of the support brace illustrated in FIG. 1.

Referring now to FIGS. 1–3, a picture frame 10 has a frame section 16 and a support tongue 18. The top end 7 of the tongue 18 is pivotably connected to the frame section 16 via a hinge structure 14. A support clip 12 is interposed under the hinge 14 between the frame section 16 and tongue 18. The clip 12 is made from a supportive spring steel. The clip 12 has a front leg 20 that parallels the frame section 16 and an integrally formed second leg 22 that parallels and abuts the inner surface 24 of tongue 18.

A patch of hook and loop connector 26 is adhered to the rear surface 28 of the frame section 16. A second complementary patch of hook and loop connector 30 is adhered to the first leg and positioned to connect with the first patch 26. Commercially available Velcro brand fasteners that are sold with an adhesive backing is desirable for ease of assembly.

The rear leg 22 has a side flange section 32 in proximity to its distal end 37. The flange section 32 is u-shaped with a distal hook portion 33 to form a laterally extending groove 34 that laterally receives the edge 36 of tongue 18. The flange section 32, hook portion 33 and the formed groove 34 is referred to as the catch 35. The distal hook portion 33 of the flange section 32 abuts and captures the tongue outer surface 38. The side flange 32 extends sideways such that the first and second legs 20 and 22 can be positioned centrally to most tongues 18 while the edge of the tongue is received within the groove 34.

The spring steel of the clip 12 can be bent at its bight section 21 with an exerted bending pressure such that the front and rear legs 20 and 22 can be set with any desired angle. The spring steel gage is thick enough to support the tongue 18 relative to the picture frame at the desired angle that the two legs 20 and 22 are set. The gage may be varied and depend on the size and weight of the particular picture frame 10. The clip is made from a strip of the spring steel as shown in FIG. 3 with the width being substantially greater than the gage.

Leg 20 is slightly longer, such as ⅜" longer, than leg 22. The extra length provides ease of separating the two legs 20 and 22 by allowing both the distal end 40 of leg 20 and flange 32 of leg 22 to be easily grasped when the legs 20 and 22 are in a closed position and abutting each other for packaging and shipment.

Figure 4:
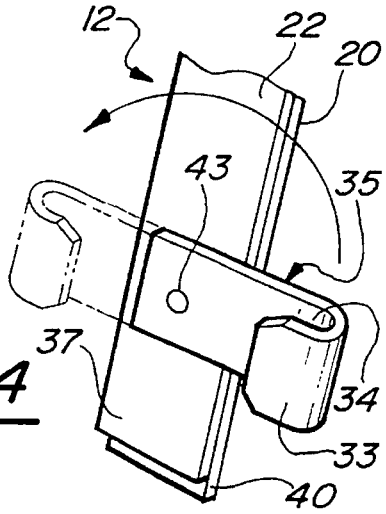
FIG. 4 is a fragmentary rear perspective view illustrating a second embodiment of the clip and catch.

Referring now to FIG. 4, an alternate clip 12 is shown. Comparable parts with the first embodiment will have the same numbers for ease in comparison. The catch 35 is pivotably mounted about a rivet 43 relative to the distal section 37. The pivoting of the catch 35 allows the catch 35 to be reversible and allows a choice of either the edge 36 or opposite edge 45 of the tongue 18 to be secured in the catch 35 and supported by the clip 12. The clip 12 is shown in the closed storage position to illustrate the lower edge 40 of front leg 20 being below section 37 of rear leg 22 as described for the first embodiment.

Figure 5:
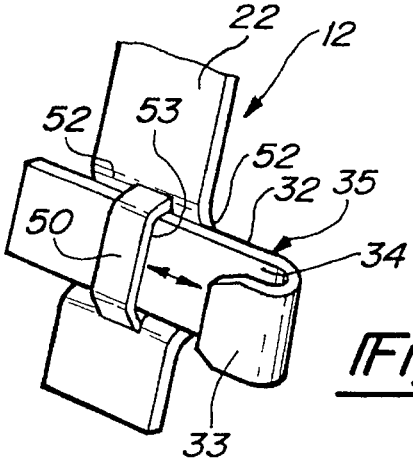
FIG. 5; is a fragmentary rear perspective view of a third embodiment of the clip and catch.

Reference is now made to FIG. 5 in which a further modified clip 12 is illustrated. A reversible catch member 35 is slidably inserted through a slot 53 laterally extending through leg 22. The slot 53 is formed by the spacing of a center strip 50 with respect to two side strips 52 in leg 22. The two side strips 52 positioned on each side of center strip 50 prevent the catch from pivoting when it is installed through the slot 53. The catch member 35 has a groove 34 that engages a choice of either the edge 36 or opposite edge 45 of the tongue depending on which way the catch is inserted through the slot 63. Furthermore, the catch 35 can slide laterally to accommodate tongues of differing widths such that the legs 20 and 22 are maintained near the center line of the tongue 18.

In all the embodiments the catch 35 snugly receives the tongue 18 to secure the lower section 59 of the tongue such that the tongue is set at the desired angle set by the two legs 20 and 22 of clip 12. The adjustment of the angle is easily accomplished by exerting pressure on the legs 20 and 22 to bend the bight section 21.

The picture frame 10 then can be set at the selected angle even if the stop point for the hinge is normally at a larger angle or if the hinge stop is broken or the tongue has lost its structural integrity. This selection of a desired angle is especially advantageous if several picture frames are grouped as a collection. All the picture frames can be set at the same angle to provide for a uniform angle of presentation. Furthermore, if a collection of picture frames are presented in a small table area, the clip 12 can support the tongue to set the picture frame at an upright angle to conserve table space without compromising balance or structural support of the tongue. The clip is particularly useful if the hinge stop is broken which would otherwise have the tongue support the picture frame at a greatly splayed angle or even render the tongue useless in supporting the picture frame in an upright position.

The clip 12 can be used where the tongue has even become completely detached from the picture frame section. The clip can function as a secure bridge between the two elements to restore the structural integrity of the picture frame assembly.

The picture frame can be lifted or moved to another location and set down directly without the clip becoming detached. The tongue will retain its position as set by the clip during normal lifting and moving but will be able to be reset upon deliberate pressure to reset the tongues cant.

Other variations and modifications are possible without departing from the scope and spirit of the present invention as defined by the appended claims.

The embodiments in which an exclusive property or privilege is claimed are defined as follows:

1. A picture frame characterized by:

a front frame section constructed for containing a picture;

a support tongue having a top end hingedly connected to a rear surface of the front frame section;

a hinge for connecting the support tongue to the front frame section;

a support brace interposed under the hinge between the tongue and front frame section having two leg sections with a first leg section parallel to the front frame section and a second leg parallel to the support tongue when said tongue is in an operative support position;

said first and second legs being integrally formed together and being adjustably affixable set at a selected downwardly extending angle through a top bendable bight section with both said first and second legs extending downwardly from said top bight section;

first and second components of a detachable fastening mechanism are secured onto the respective first leg and said rear surface of said frame section for removably attaching said first leg to said rear surface of said frame section;

said second leg having a catch for removably being secured to said tongue such that said tongue is secured with respect to said frame section at said selected angle.

2. A picture frame as defined in claim 1 further characterized said first and second components of said detachable fastening mechanism being a hook and loop fastening device with one of a hook connector and loop connector being secured on the picture frame and the other of the hook connector and loop connector being secured on an opposing surface of the first leg.

3. A picture frame as defined in claim 1 further characterized by:

said catch on said second leg being a flange on said second leg being bent to form a distal hook section and a groove formed therebetween to laterally receive said tongue.

4. A picture frame as defined in claim 1 further characterized by:

said catch on said second leg being u-shaped and pivotably connected onto said second leg forming a groove to receive a selected left or right edge of said tongue depending on the pivoted position of said u-shaped catch.

5. A picture frame as defined in claim 1 further characterized by:

said second leg having a slot that runs horizontal and laterally therethrough;

a u-shaped catch having a leg that slidably extends through said slot and forming a groove that receives a selected left or right edge of said tongue depending on the position of said u-shaped catch through said slot.

6. A picture frame as defined in claim 1, further characterized by:

said support brace being made from a flat strip of semi-rigid supportive material such that said bight section is bendable under manual pressure to set the relative angle of said first and second legs.

7. A picture frame characterized by:

a front frame section constructed for containing a picture;

a support tongue having a top end hingedly connected to a rear surface of the front frame section;

a hinge for connecting the support tongue to the front frame section;

a support brace interposed under the hinge between the tongue and front frame section having two legs with a first leg parallel to the front frame section and a second leg parallel to the support tongue;

said first and second leg being integrally formed together and being adjustable set at a selected angle through a top bendable bight section;

first and second components of a detachable fastening mechanism are secured onto the respective first leg and said rear surface of said frame section for removably attaching said first leg to rear surface of said frame section;

said second leg having a catch for removably being secured to said tongue such that said tongue is secured with respect to said frame section at said selected angle; and said first and second components of said detachable fastening mechanism being a hook and loop fastening device with one of a hook connector and loop connector being secured on the picture frame and the other of the hook connector and loop connector being secured on an opposing surface of the first leg.

8. A picture frame as defined in claim 7 further characterized by:

said catch on said second leg being a flange on said second leg being bent to form a distal hook section and a groove formed therebetween to laterally receive said tongue.

9. A picture frame as defined in claim 7 further characterized by:

said catch on said second leg being u-shaped and pivotably connected onto said second leg forming a groove to receive a selected left or right edge of said tongue depending on the pivoted position of said u-shaped catch.

10. A picture frame as defined in claim 7 further characterized by:

said second leg having a slot that runs horizontal and laterally therethrough;

a u-shaped catch having a leg that slidably extends through said slot and forming a groove that receives a selected left or right edge of said tongue depending on the position of said u-shaped catch through said slot.

* * * * *